US008497438B2

(12) United States Patent
Chauvet et al.

(10) Patent No.: US 8,497,438 B2
(45) Date of Patent: Jul. 30, 2013

(54) EMERGENCY STOP DEVICE

(75) Inventors: Francis Chauvet, Moutiers (FR); Dominique Benni, Mornac (FR); Bertrand Fruchard, L'Isle d'Espagnac (FR)

(73) Assignee: Schneider Electric Industries SAS, Rueil-Malmaison (FR)

( * ) Notice: Subject to any disclaimer, the term of this patent is extended or adjusted under 35 U.S.C. 154(b) by 335 days.

(21) Appl. No.: 13/119,193

(22) PCT Filed: Oct. 1, 2009

(86) PCT No.: PCT/EP2009/062736

§ 371 (c)(1), (2), (4) Date: Mar. 16, 2011

(87) PCT Pub. No.: WO2010/040678

PCT Pub. Date: Apr. 15, 2010

(65) Prior Publication Data

US 2011/0168536 A1 Jul. 14, 2011

(30) Foreign Application Priority Data

Oct. 7, 2008 (FR) ..... 08 56780

(51) Int. Cl.
*H01H 27/00* (2006.01)

(52) U.S. Cl.
USPC ..... 200/43.04; 200/43.07; 200/16 A; 200/334

(58) Field of Classification Search
USPC ..... 200/1 R, 16 R–16 D, 17 R, 17 B, 200/43.01–43.09, 50.06, 520, 533–538, 540, 200/541, 293, 303, 307, 318–318.2, 329–331, 200/334
See application file for complete search history.

(56) References Cited

U.S. PATENT DOCUMENTS

| | | | | |
|---|---|---|---|---|
| 2,360,128 | A * | 10/1944 | Hausler | 74/100.2 |
| 3,024,333 | A * | 3/1962 | Brandenberg | 200/534 |
| 3,040,142 | A * | 6/1962 | Dietrich et al. | 335/126 |
| 4,284,864 | A * | 8/1981 | Crow et al. | 200/537 |
| 6,028,274 | A * | 2/2000 | Harris | 200/52 R |
| 6,198,058 | B1 * | 3/2001 | Graninger et al. | 200/50.02 |
| 7,605,337 | B2 * | 10/2009 | Scherl et al. | 200/405 |

(Continued)

FOREIGN PATENT DOCUMENTS

EP 1 801 830 6/2007

OTHER PUBLICATIONS

International Search Report issued Dec. 23, 2009 in PCT/EP09/62736 filed Oct. 1, 2009.

*Primary Examiner* — Michael Friedhofer
(74) *Attorney, Agent, or Firm* — Oblon, Spivak, McClelland, Maier & Neustadt, L.L.P.

(57) ABSTRACT

The invention relates to a switching device comprising:—a first assembly (1) comprising an actuation member (10) that can take a rest position and an actuation position;—a second assembly (2) mounted on the first assembly (1) and comprising a mobile bridge (22) bearing mobile contacts (221) actuated with respect to fixed contacts (201) between an opening position and a closing position so as to respectively open or close an electrical circuit according to the position of the actuation member (10), in which:—the mobile bridge (22) is actuatable in rotation about an axis of rotation (A) and can take a third position so as to open the electrical circuit when the first assembly (1) is mechanically disconnected from the second assembly (2).

12 Claims, 3 Drawing Sheets

U.S. PATENT DOCUMENTS

Figures 1, 1A, 1B, 1C:
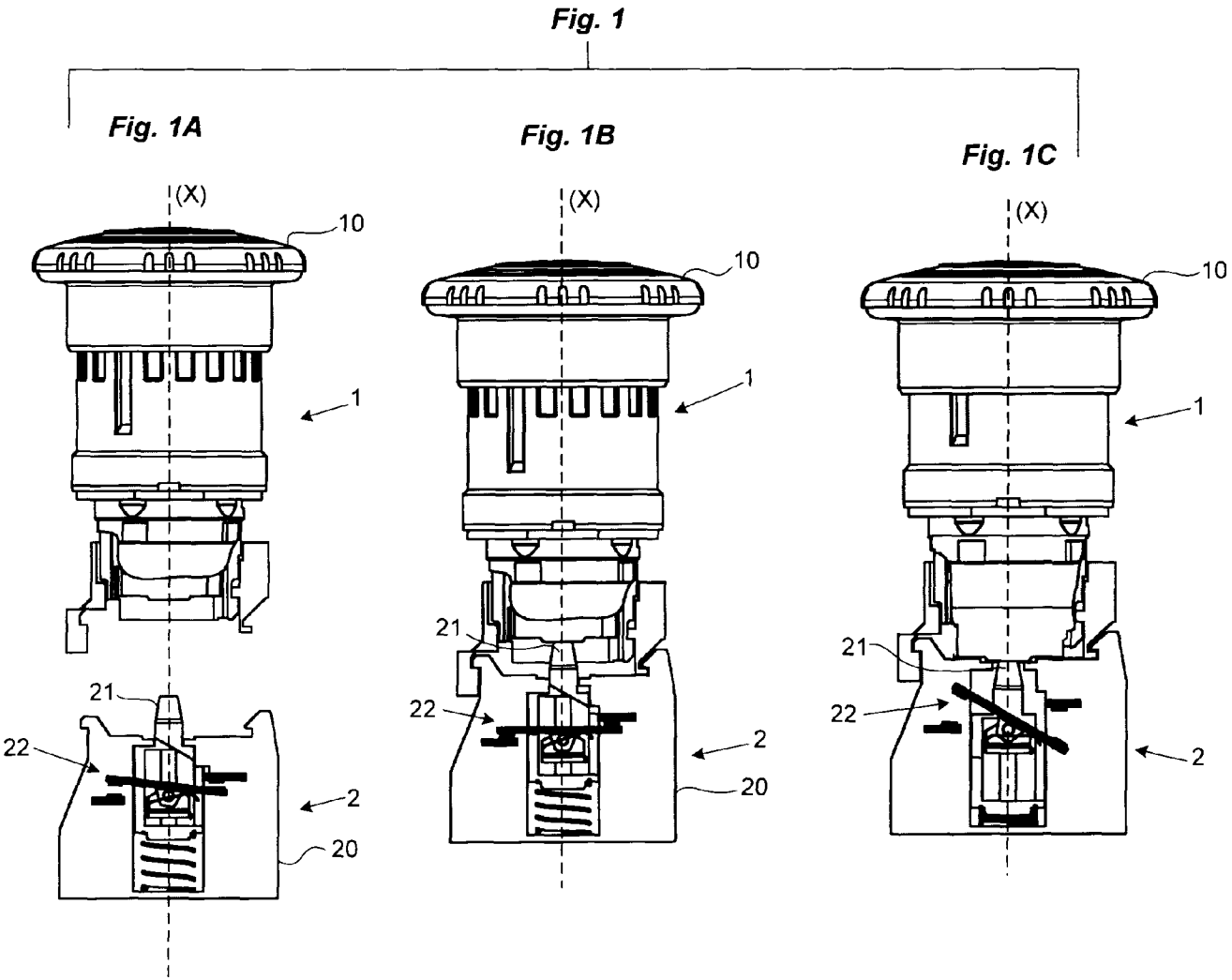

| | | | | |
|---|---|---|---|---|
| 8,003,909 | B2 * | 8/2011 | Gessler | 200/334 |
| 8,115,122 | B2 * | 2/2012 | Machida et al. | 200/43.07 |
| 2003/0070905 | A1 * | 4/2003 | Schaefer | 200/16 A |
| 2008/0000760 | A1 | 1/2008 | Ng et al. | |
| 2009/0084663 | A1 | 4/2009 | Scherl | |

* cited by examiner (X)
10
1
2
20
21
22

EMERGENCY STOP DEVICE

The present invention relates to a switching device. The invention relates more particularly to a switching device of the emergency stop type.

In general, an emergency stop device comprises a first assembly supporting the actuation member and a second assembly formed from a contact block designed to be mounted on the first assembly. The contact block comprises a movable bridge supporting movable contacts actuated by the actuation member relative to fixed contacts between a closed position and an open position in order respectively to close or open an electric circuit. In an emergency stop device, the contacts are of the normally closed type.

When the device is mounted, the first assembly and the second assembly are mounted mechanically on either side of a wall. The contact block is therefore invisible to the user. It is therefore impossible for the user to know at all times whether the first assembly is correctly mounted on the second assembly. However an uncoupling of one of the assemblies relative to the other no longer allows the device to operate correctly. Since an emergency stop device is designed to perform a safety function, this device must operate correctly. For this, it is therefore necessary to ensure that the first assembly is correctly coupled to the second assembly.

Notably known from patents U.S. Pat. No. 6,198,058 and DE4101493 are devices that make it possible to monitor the coupling of the first assembly to the second assembly. In these two patents, a set of normally closed contacts and a set of normally open contacts are placed in series on the electric circuit to be controlled. When the first assembly is mounted on the second assembly, the normally open contacts close, making it possible to ensure that the two assemblies are correctly mounted. In normal operation, when there is a pressure on the actuation member, the normally closed contacts open.

The object of the invention is to propose a new solution making it possible to ensure that the first assembly is correctly mounted on the second assembly. This solution is simple to operate and is achieved in a limited space.

This object is achieved by a switching device which comprises:

- a first assembly comprising an actuation member that is able to take a rest position and an actuation position,
- second assembly mounted on the first assembly and comprising a movable bridge supporting movable contacts actuated relative to fixed contacts between an open position and a closed position in order respectively to open or close an electric circuit depending on the position of the actuation member,
- the movable bridge being able to be rotated about a rotation axis and able to take a third position in order to open the electric circuit when the first assembly is mechanically disconnected from the second assembly.

According to the invention, the second assembly comprises actuation means for acting on the movable bridge on either side of its rotation axis and in opposite directions. These actuation means are for example included in a push-button that can be actuated between three positions corresponding to the three positions of the movable bridge.

According to a particular feature of the invention, the actuation means comprise for example two cams made on the push-button and between which the movable bridge is inserted.

According to another particular feature of the invention, the second assembly comprises a first spring forcing the push-button in translation. This first spring is for example of the helical type.

According to another particular feature of the invention, the second assembly comprises a second spring forcing the movable bridge to its closed position. This second spring is for example of the leaf type.

According to another particular feature, the movable bridge comprises two movable contacts placed on either side of the rotation axis and on two opposite faces of a support plate mounted so as to rotate about the rotation axis.

According to the invention, the three positions taken by the movable bridge are distinct, the third position taken by the movable bridge being a second open position of the electric circuit.

The switching device formed by the first assembly and the second assembly is for example an emergency stop device.

According to the invention, compared with the prior art, the invention therefore has the advantage of using the same movable bridge to perform both the function of monitoring the mounting of the first assembly on the second assembly and the normal function of the switching device of the emergency stop type.

Consequently, even if the fixed and movable contacts are welded together, the actuation of the actuation member will make it possible to open the contacts. On the other hand, in the prior art, since the two functions are fulfilled with the aid of two distinct movable bridges, if the normally open contacts used for monitoring the mounting of the head are welded together, the actuation of the actuation member cannot be used to separate them. The function of monitoring the mounting of the first assembly on the second assembly can therefore no longer be performed.

Figure 2A:
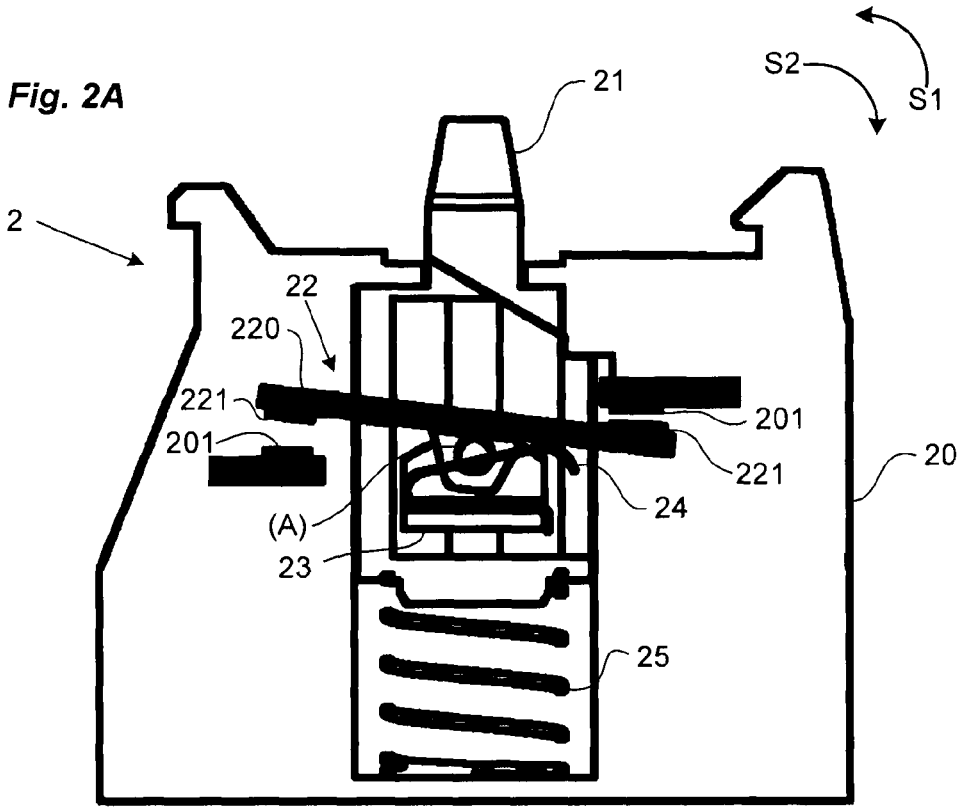
Figure 2B:
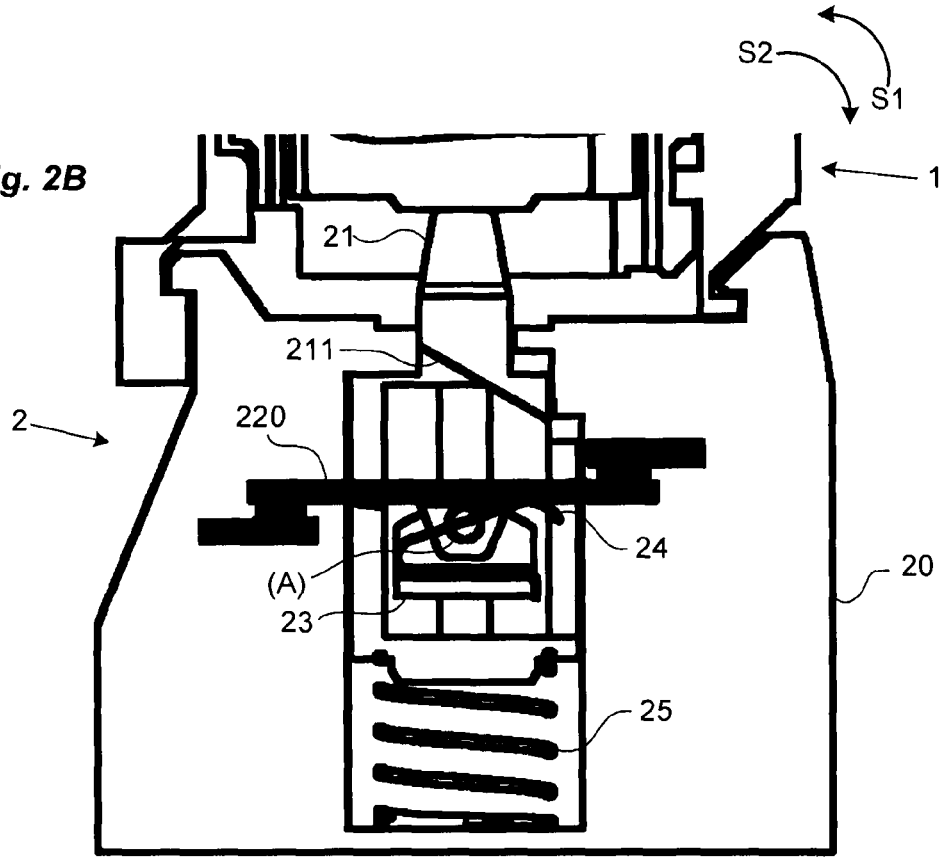
Figure 2C:
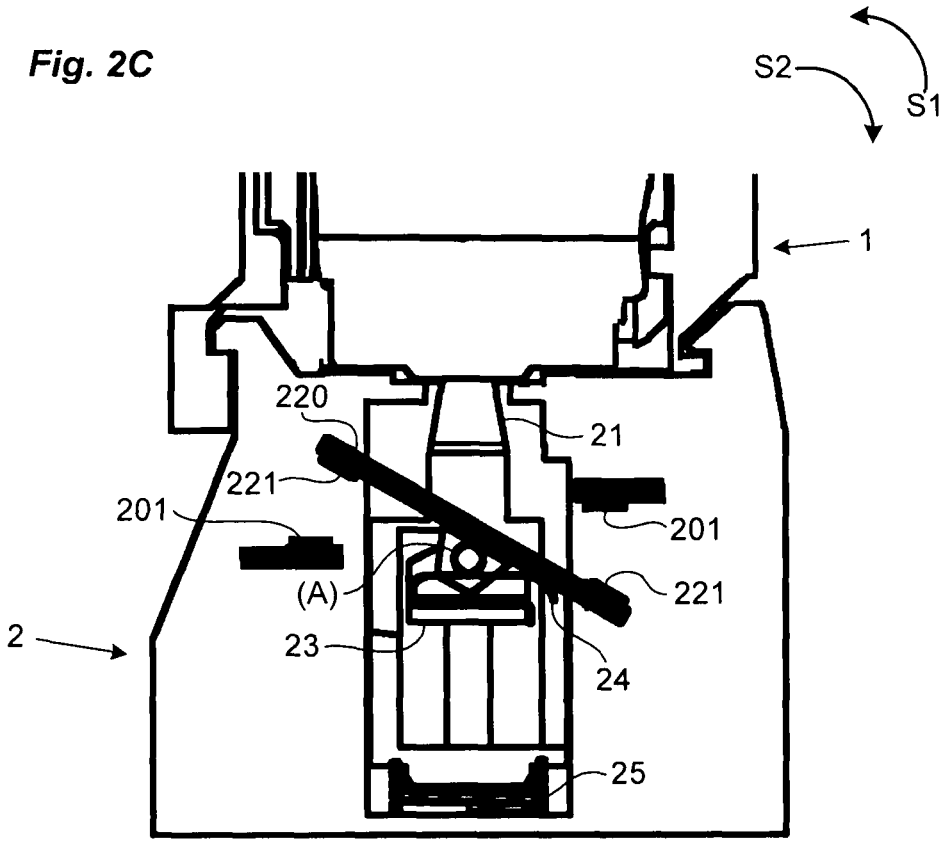
Figure 3:
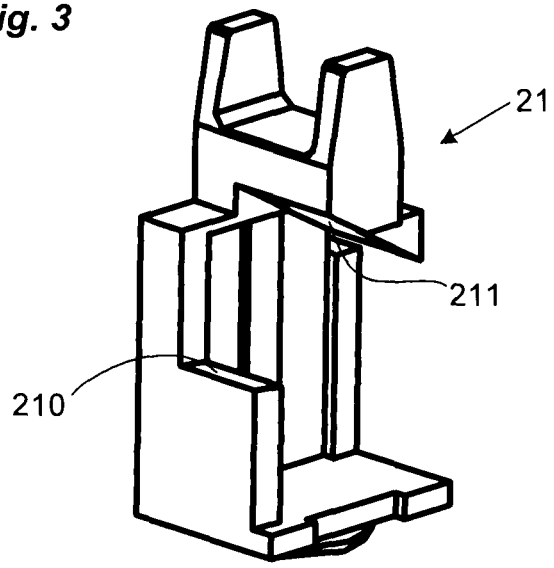

Other features and advantages will appear in the following detailed description by referring to an embodiment given as an example and depicted by the appended drawings in which:

FIG. 1A represents the two separate assemblies of the switching device of the invention, FIG. 1B represents the first assembly of the switching device correctly mounted on the second assembly, the actuation member being in the rest position, FIG. 1C represents the first assembly of the switching device correctly mounted on the second assembly, the actuation member being in the actuation position, FIGS. 2A to 2C show in greater detail the second assembly in the three states defined in FIGS. 1A to 1C, FIG. 3 shows in perspective the push-button used in the second assembly of the device.

In the appended drawings, FIG. 1 groups together FIGS. 1A to 1C.

The invention relates to a switching device and more particularly to an emergency stop device.

In a known manner, a switching device of the emergency stop type comprises two distinct assemblies 1, 2.

The first assembly 1 comprises an actuation member 10 designed to be pushed in the event of an emergency by the operator along an axis (X) in order to open an electric circuit. The actuation member 10 can thus take a rest position (FIG. 1B) in which it is not pushed in, leaving the electric circuit closed, and an actuation position (FIG. 1C) in which it is pushed in order to open the electric circuit.

The second assembly 2 is a contact block designed for controlling the electric circuit (not shown). A contact block usually comprises a housing 20 containing a push-button 21 (FIG. 3) on which the actuation member 10 acts, and a movable bridge 22 supporting movable contacts 221, said movable bridge 22 being set in motion relative to fixed contacts 201 between a closed position and an open position in order respectively to close or open the electric circuit depending on the position of the actuation member 10. When the actuation member 10 is in the rest position, the movable bridge 22 is in the closed position of the electric circuit (FIG. 1B) and when the actuation member 10 is in the actuation position, the movable bridge 22 is in the open position of the electric circuit (FIG. 1C).

The switching device of the invention also comprises means making it possible to monitor whether the second assembly 2 is correctly coupled to the first assembly 1. These means consist in keeping the electric circuit open while the first assembly 1 is mechanically disconnected from the second assembly 2.

According to the invention, the movable bridge 22 of the second assembly 2 is of the rotary type and can be rotated about a rotation axis (A) included in a plane perpendicular to the actuation axis (X) of the actuation member 10. According to the invention, the movable bridge 22 can take three distinct positions about its rotation axis (FIGS. 2A to 2C). The movable bridge 22 can therefore take said closed position (FIG. 1B) when the first assembly 1 is correctly mounted on the second assembly 2 and the actuation member 10 is in the rest position, said open position (FIG. 1C) when the first assembly 1 is correctly mounted on the second assembly 2 and the actuation member 10 is in the actuation position and a third position (FIG. 1A) which is a second open position in which the first assembly 1 is mechanically disconnected from the second assembly 2. Therefore, by virtue of this third position, the electric circuit remains open if the first assembly 1 is not correctly mounted on the second assembly 2. When the first assembly 1 is correctly mounted on the second assembly 2, the movable bridge 22 is moved into its closed position and the emergency stop device can therefore fulfill its function.

More precisely, the movable bridge 22 comprises a plate 220 mounted so as to rotate on a support 23, said plate 220 bearing two opposite faces each supporting a movable contact 221, the two movable contacts 221 being placed on each of the faces on either side of the rotation axis (A). Facing each movable contact 221, the housing 20 of the second assembly 2 contains a fixed contact 201 connected to the electric circuit to be controlled. The movable bridge 22 is mounted on a spring, for example of the leaf type 24, forcing it about its rotation axis (A) in the counterclockwise direction (S1) to its closed position, said spring 24 being housed between the plate 220 and the support 23 of the movable bridge.

The push-button 21 is also mounted on a spring 25, for example of the helical type, housed in the bottom of the housing 20 of the second assembly 2 and forcing the push-button 21 in translation along the axis (X) against the movement of the actuation member 10 when the two assemblies 1, 2 are coupled together. By virtue of a slide, the push-button 21 is guided in translation along the axis (X) in a groove made on the housing 20 of the second assembly 2.

According to the invention, the second assembly 2 also comprises actuation means making it possible to rotate the movable bridge 22 between its positions by acting on the movable bridge on either side of its rotation axis (A) in directions parallel to the axis (X) and in opposite directions. These actuation means comprise two cams 210, 211 (FIG. 3) formed on the push-button 21. The movable bridge is inserted between the two cams 210, 211 of the push-button 21 so that a first cam 210 of the push-button is capable of pressing on a first face of the plate 220 of the movable bridge, on one side of the rotation axis (A), in order to rotate the latter in the clockwise direction (S2) and so that a second cam 211 of the push-button is capable of pressing on the opposite face of the plate 220 of the movable bridge 22, on the other side of the rotation axis (A), in order to rotate the latter in the clockwise direction (S2). The two cams 210, 211 therefore both rotate the movable bridge in the clockwise direction (S2), but, depending on the position of the push-button 21, they act in two directions that are substantially parallel to the axis (X) on the two opposite faces of the plate 220 of the movable bridge 22 and on either side of the rotation axis (A) of the movable bridge 22, so as to confer two distinct positions (FIGS. 2A and 2C) on the latter.

According to the invention, the three distinct positions taken by the movable bridge 22 therefore correspond to three positions taken by the push-button 21. The three positions are explained below:

When the first assembly 1 is mechanically disconnected from the second assembly 2, the push-button 21 is forced toward the outside of the housing 20 by the helical spring 25. The first cam 210 of the push-button then presses on one side of the rotation axis (A) and on the first face of the plate 220 of the movable bridge 22 in order to rotate it in the clockwise direction (S2) against its leaf spring 24 and thus cause it to take the third position, leaving the electric circuit open when the first assembly 1 is mechanically disconnected from the second assembly 2 (FIG. 2A).

When the first assembly 1 is correctly mounted on the second assembly 2, the actuation member 10 in the rest position then presses on the push-button 21 so as to compress its helical spring 25. The push-button 21 is therefore no longer pressing against the movable bridge 22 via the first cam 210. The movable bridge 22 is then forced to rotate in the counterclockwise direction (S1) by its only leaf spring 24 to its closed position of the circuit (FIG. 2B).

When the first assembly 1 is correctly mounted on the second assembly 2, and when the actuation member 10 is actuated to its actuation position, the latter acts on the push-button 21 and compresses the helical spring 25 toward the bottom of the housing 20. The second cam 211 of the push-button 21 then presses on the movable bridge 22 on the other side of its rotation axis (A) and on the second face of the plate 220 of the movable bridge so as to rotate the latter in the clockwise direction (S1) and thus cause it to take its open position of the electric circuit (FIG. 2C).

Therefore, by using a single movable bridge to perform simultaneously the normal function of the emergency stop device and the function of monitoring the joining of the two assemblies 1, 2, the solution of the invention is particularly simple, low-cost and requiring limited space.

The invention claimed is:

1. A switching device comprising:

a first assembly comprising an actuation member that is able to take a rest position and an actuation position, a second assembly mounted on the first assembly and comprising a movable bridge supporting movable contacts actuated relative to fixed contacts between an open position and a closed position in order respectively to open or close an electric circuit depending on the position of the actuation member, wherein:

the movable bridge can be rotated about a rotation axis and can take a third position in order to open the electric circuit when the first assembly is mechanically disconnected from the second assembly.

2. The device as claimed in claim 1, wherein the second assembly comprises actuation means for acting on the movable bridge on either side of its rotation axis and in opposite directions.

3. The device as claimed in claim 2, wherein the actuation means are included in a push-button that can be actuated between three positions corresponding to the three positions of the movable bridge.

4. The device as claimed in claim 3, wherein the actuation means comprise two cams made on the push-button and between which the movable bridge is inserted.

5. The device as claimed in claim 3, wherein the second assembly comprises a first spring forcing the push-button in translation.

6. The device as claimed in claim 5, wherein the first spring is of the helical type.

7. The device as claimed in claim 6, wherein the second assembly comprises a second spring forcing the movable bridge to its closed position.

8. The device as claimed in claim 7, wherein the second spring is of the leaf type.

9. The device as claimed in claim 1, wherein the movable bridge comprises two movable contacts placed on either side of the rotation axis and on two opposite faces of a support plate mounted so as to rotate about the rotation axis.

10. The device as claimed in claim 1, wherein the three positions taken by the movable bridge are distinct.

11. The device as claimed in claim 10, wherein the third position taken by the movable bridge is a second open position of the electric circuit.

12. The device as claimed in claim 1, wherein the first assembly and the second assembly form an emergency stop device.

* * * * *